US011746470B2

(12) United States Patent
Mansikkasalo et al.

(10) Patent No.: US 11,746,470 B2
(45) Date of Patent: Sep. 5, 2023

(54) METHOD FOR CONTROLLING CARRYOVER IN A CHEMICAL RECOVERY BOILER AND A CHEMICAL RECOVERY BOILER

(71) Applicant: Valmet Automation Oy, Espoo (FI)

(72) Inventors: Jarmo Mansikkasalo, Pirkkala (FI); Jukka Koskinen, Tampere (FI)

(73) Assignee: VALMET AUTOMATION OY, Espoo (FI)

( * ) Notice: Subject to any disclaimer, the term of this patent is extended or adjusted under 35 U.S.C. 154(b) by 426 days.

(21) Appl. No.: 17/015,635

(22) Filed: Sep. 9, 2020

(65) Prior Publication Data

US 2021/0071361 A1 Mar. 11, 2021

(30) Foreign Application Priority Data

Sep. 9, 2019 (FI) ..... 20195743

(51) Int. Cl.
*D21C 11/12* (2006.01)
*F23G 7/04* (2006.01)
(Continued)

(52) U.S. Cl.
CPC ..... *D21C 11/12* (2013.01); *F23G 7/04* (2013.01); *F22B 1/20* (2013.01); *F22B 35/00* (2013.01);
(Continued)

(58) Field of Classification Search
CPC . D21C 11/129; F23G 7/04; F23G 5/50; F23G 2209/101; F22B 35/00
See application file for complete search history.

(56) References Cited

U.S. PATENT DOCUMENTS 3,170,442 A * 2/1965 Hochmuth ..... D21C 11/063 122/479.6
4,768,469 A 9/1988 IIzuka et al.
(Continued)

FOREIGN PATENT DOCUMENTS

| | | | |
|---|---|---|---|
| JP | H04-11088 | A | 1/1992 |
| JP | H06-17390 | A | 1/1994 |
| WO | WO-98/27474 | A1 | 6/1998 |

OTHER PUBLICATIONS

Office Action and Search Report for Finnish Patent Application No. 20195743, filed Apr. 8, 2020, (7 pages), Finnish Patent and Registration Office, Helsinki, Finland.

*Primary Examiner* — David J Laux
(74) *Attorney, Agent, or Firm* — Alston & Bird LLP

(57) ABSTRACT

A method for controlling carryover in a chemical recovery boiler. The method comprises feeding black or brown liquor to a furnace of the chemical recovery boiler through an injection gun to burn the black or brown liquor. The chemical recovery boiler comprises a bullnose, which narrows the furnace, and a first superheater, of which at least a part is arranged at a higher vertical level than the bullnose. The method comprises measuring information indicative of a spatial temperature distribution on a cross section of the furnace, wherein the cross section is above the injection gun and below the first superheater; determining primary information indicative of carryover using the information indicative of the spatial temperature distribution on the cross section of the furnace; and controlling a temperature of the black or brown liquor that is fed to the furnace using the primary information. In addition, a system for performing the method.

21 Claims, 7 Drawing Sheets

(51) Int. Cl.
*F22B 1/20* (2006.01)
*F23G 5/50* (2006.01)
*F22B 35/00* (2006.01)

(52) U.S. Cl.
CPC ..... *F23G 5/50* (2013.01); *F23G 2207/101* (2013.01); *F23G 2209/101* (2013.01)

(56) References Cited

U.S. PATENT DOCUMENTS 5,419,812 A * 5/1995 Beal ..... D21C 11/12 162/263
5,715,763 A 2/1998 Fornetti et al.
5,992,337 A * 11/1999 Philippe ..... D21C 11/12 110/238
6,279,495 B1 * 8/2001 Karidio ..... F23C 5/28 110/297
2011/0061575 A1 * 3/2011 Seeker ..... F23N 5/022 110/189
2012/0053720 A1 * 3/2012 Mathur ..... G05B 13/042 703/2
2013/0014514 A1 * 1/2013 Romig ..... F02C 7/224 60/776
2015/0253003 A1 * 9/2015 Jones ..... F22B 35/18 122/479.1
2018/0080173 A1 * 3/2018 Koskinen ..... D21C 11/122

* cited by examiner

Tmag < Tl2

Tvar < Tl1

Tmag < Tl2

Tvar > Tl1

Tmag > Tl2

Tvar < Tl1

Tmag > Tl2

Tvar > Tl1

METHOD FOR CONTROLLING CARRYOVER IN A CHEMICAL RECOVERY BOILER AND A CHEMICAL RECOVERY BOILER

CROSS REFERENCE TO RELATED APPLICATIONS

This application claims priority to and the benefit of Finnish Patent Application No. 20195743, filed Sep. 9, 2019; the contents of which as are hereby incorporated by reference in their entirety.

BACKGROUND

Related Field

The invention relates to chemical recovery boilers. The invention relates to methods for controlling chemical recovery boilers. Chemical recovery boilers are used in the production of pulp to recover cooking chemicals by burning black liquor or brown liquor.

Description of Related Art

Chemical recovery boilers are used in the production of pulp to recover cooking chemicals by burning black liquor or brown liquor. Black liquor is an intermediate product in the Kraft process (i.e. sulphate process) and brown liquor is an intermediate product in the sulphite process. In the recovery process, concentrated black liquor (in sulphate process) or brown liquor (in sulphite process) is fed to a furnace of the recovery boiler in form of droplets. Depending on the size of the droplets, some of the droplets fall onto a char bed, thereby forming a part of the char bed, to be reduced therein, and some of the droplets may flow with flue gas upwards. The upwards flowing droplets pose the problem of carryover, which is a phenomenon, in which the droplets flow onto heat transfer surfaces of the chemical recovery boiler. This may cause malfunction and/or corrosion of the chemical recovery boiler. Therefore, carryover needs to be controlled, and more preferably reduced or even eliminated.

In the past, carryover has been minimized mainly by the design of the injection gun(s) used to feed black liquor into the furnace. The document U.S. Pat. No. 5,715,763 discloses such a solution. In addition, the document JP H0617390 discloses a method for controlling carryover. Moreover, the document JP H0411088 discloses controlling a combustion state in a boiler.

BRIEF SUMMARY

It has now been found that carryover can be, on one hand, determined by measuring values indicative of a temperature distribution on a cross section of the furnace of the chemical recovery boiler. The cross section is arranged in between an injection gun and a superheater. When carryover is determined, the combustion process, in particular the size of the liquor droplets, is controlled by controlling the temperature at which the liquor (black or brown) is fed into the furnace. In this way, carryover can be reduced. Moreover, carryover can be reduced in such a way that the reduction efficiency of the boiler remains simultaneously at an acceptable level.

A corresponding method is disclosed in more specific terms in the independent claim 1. A corresponding chemical recovery boiler is disclosed in more specific terms in the independent claim 10.

In the figures, the vector G indicates a direction of gravity.

DETAILED DESCRIPTION OF VARIOUS EMBODIMENTS

The invention is described in the context of a Kraft process, wherein concentrated black liquor is burnt in a chemical recovery boiler to recover cooking chemicals. However, the principles are applicable also in a chemical recovery boiler of a sulphite process (i.e. a soda recovery boiler). In view of the presented examples, the only difference is that in the sulphite process brown liquor (or concentrated brown liquor) is burnt instead of black liquor (or concentrated black liquor). This applies to all embodiments presented hereinbelow.

Figure 1:
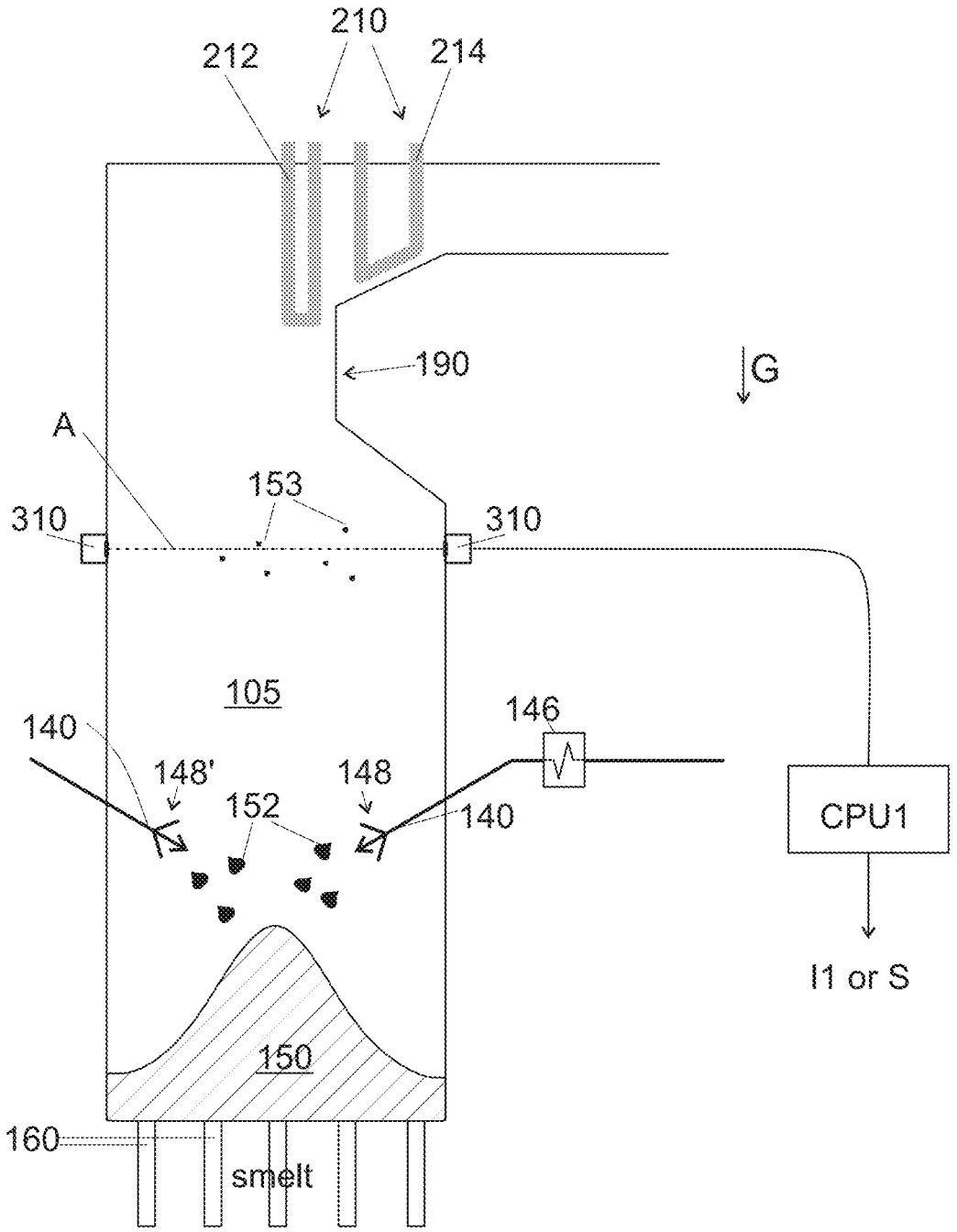
FIG. 1 is a principal side view of an embodiment of a chemical recovery boiler.
Figure 2:
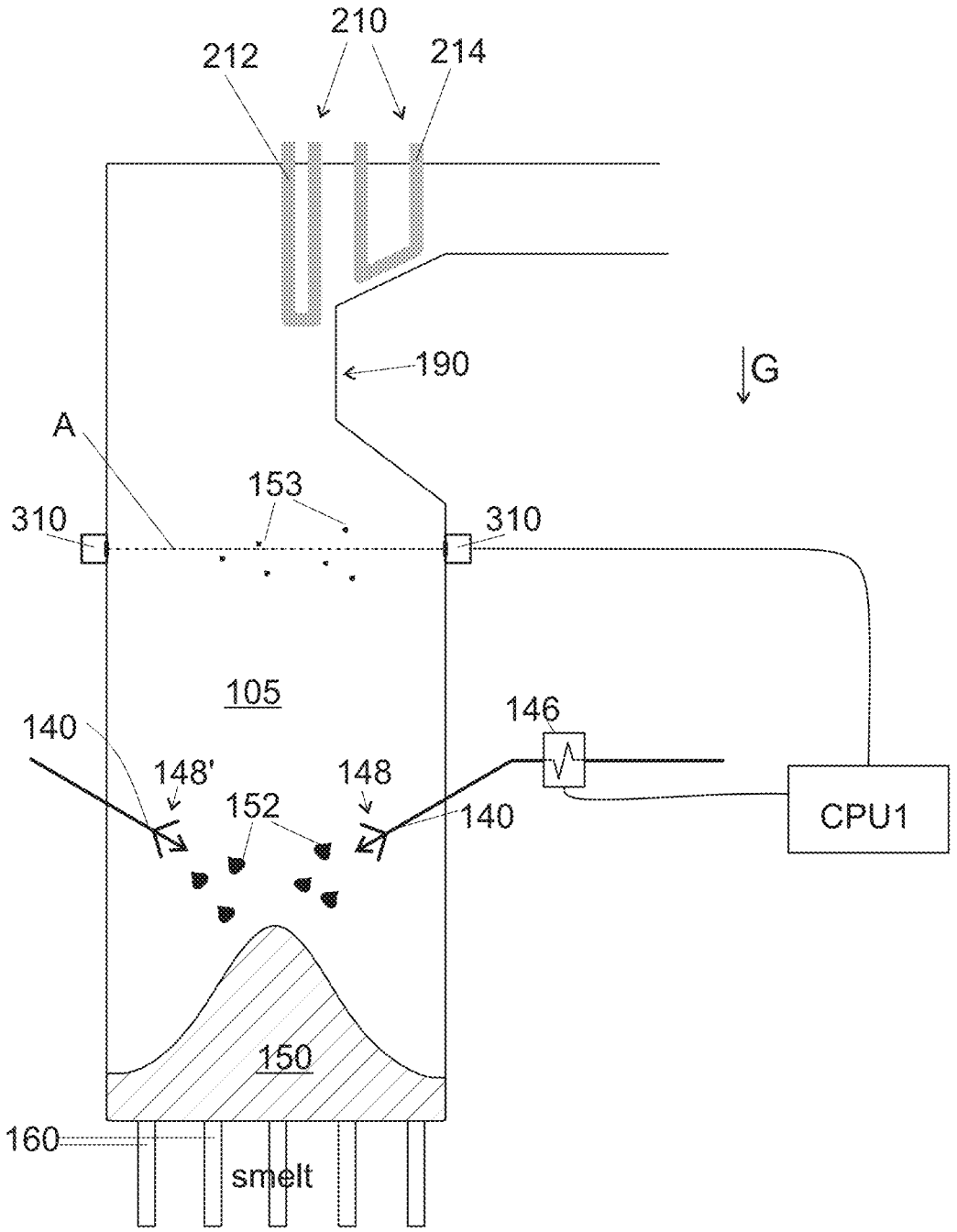
FIG. 2 is a principal side view of an embodiment of a chemical recovery boiler, wherein a processor is configured to control a temperature of the liquor (black or brown)

FIGS. 1 and 2 show a chemical recovery boiler 100 configured to burn concentrated black liquor to produce heat and smelt. Heat is produced by burning the concentrated black liquor. The smelt forms a char bed 150 in a lower part of a furnace 105 of the chemical recovery boiler 100. The smelt is let out from the boiler 100 through smelt spouts 160 for further use as part of green liquor, as known in the art.

The heat thus produced is recovered by heat exchangers including superheaters 210 and economizers (not shown). Economizers are arranged in a flue gas channel downstream from a superheater; downstream in the direction of the flow of the flue gases. The heat may be recovered at other heat transfer surfaces such as a boiler bank and/or a screen 320, too. Herein the superheaters are commonly denoted by the reference 210, while a first superheater is denoted by the reference 212.

The chemical recovery boiler 100 comprises comprises a bullnose 190, which narrows the furnace 105. At least a part of a first superheater 212 is arranged at a higher vertical level than the bullnose 190. A purpose of the bullnose 190 is to protect at least one of the superheaters, e.g. the first superheater 212 or a second superheater 214, from too hot radiative heat transfer and/or from direct exposure to carryover. A purpose of the bullnose 190 is to guide the flue gas flow through the superheaters 210, in particular also through the first superheater 212. For these reasons, at least a part of the first superheater 212 is arranged at a higher vertical level than the bullnose 190.

In order to burn the black liquor, the chemical recovery boiler 100 comprises a channel 140 for feeding concentrated black liquor into to boiler 100. Concentrated black liquor is fed to the furnace 105 through an injection gun 148, typically through multiple injection guns 148. The injection gun(s) 148 form(s) droplets 152 of concentrated black liquor within the furnace 105. In this way, an embodiment of a method for controlling carryover in the chemical recovery boiler 100 comprises feeding black liquor to a furnace 105 of the chemical recovery boiler 100 through an injection gun 148 to burn the black liquor.

Depending on the size of the droplets 152 and air flow within the furnace 105, some of the droplets fall onto the char bed 150 thereby forming a part of the char bed 150, and some of the droplets may flow with flue gas towards the superheaters 210. The particles that flow with the flue gas are commonly referred to as carryover particles 153, and the phenomenon is referred to as carryover. The carryover particles 153 may adhere onto the surfaces of the superheaters 210 and in this way prevent heat transfer and/or clog the flue gas passages between the heat transfer pipes of the superheaters 210. In addition, carryover, when intermixed with fly ash, lowers a melting point of the fly ash. In this way, some of the fly ash may become liquid or viscous as a result of being mixed with carryover. The resulting compound is highly corrosive. Therefore, carryover increases also the risk of corrosion. In this way, carryover needs to be controlled, and more preferably reduced or even eliminated.

Carryover can be controlled by controlling a size of the droplets 152. Small droplets 152 tend to flow with flue gas upwards, while large droplets tend to fall by gravity onto the char bed 150. Therefore, the droplets 152 should not be too small to avoid carryover.

In the pulp and paper industry, the recovery of sodium sulphide from the black liquor in the chemical recovery boiler is important to the pulp manufacturer, as the chemical is used in pulping to break the lignin of the fibres to produce pulp. In a Kraft pulp mill, the concentrated black liquor comprises sodium sulphate ($Na_2SO_4$) because of the sulphate process, and the chemical recovery boiler 100 converts a part thereof to sodium sulphide ($Na_2S$) according to the reaction $$2C+Na_2SO_4 \rightarrow 2CO_2+Na_2S$$

With respect to a sulphite process, therein the chemical reaction for recovering the chemicals may be different. Moreover, the sulphite process can use calcium, ammonium, magnesium or sodium as a base, and the recovery reaction depends on the base material.

The reaction is not always perfect, whereby some of the sodium sulphate may remain unreacted in the char bed 150. In particular, a temperature of the char bed 150 affects the reduction. Forming too large droplets by the injection gun(s) 148 has the effect that a temperature of the char bed 150 will decrease. This, in effect, reduces a reduction efficiency of the chemical recovery boiler 100. Therefore, the droplets 152 should not be too large.

Referring to FIG. 1, the size of the black liquor droplets 152 may be controlled with a temperature controller 146. By heating the black liquor, its viscosity is decreased, whereby smaller droplets are formed by the injection guns. Correspondingly, by cooling the black liquor, or by decreasing a heating power used to heat the black liquor, its viscosity is increased, whereby larger droplets are formed by the injection guns 148. Therefore, the chemical recovery boiler 100 comprises the temperature controller 146. The temperature controller 146 is configured to control a temperature of the black liquor that is fed by the injection gun 148.

It has been found that carryover can be detected from a temperature profile of the flue gas, which temperature profile is measured in between the injection gun(s) 148 and the first superheater 212. For the purpose of measuring information related to the temperature profile, the chemical recovery boiler 100 comprises a thermometer 310 configured to measure values indicative of a spatial temperature distribution on a cross section A of the furnace 105, wherein the cross section A is above the injection gun(s) 148 and below the first superheater 212. Preferably, the cross section A is substantially horizontal. More precisely, preferably, a normal of the cross section A forms an angle of at most 30 degrees with a vertical direction. More preferably the angle is at most 10 degrees.

It has been found that from the spatial temperature distribution or from the values indicative of a spatial temperature distribution, one can detect carryover, i.e. at least one of the following:

- presence of carryover particles 153 within the cross section A,
- change of an amount of carryover particles 153 within the cross section A, and
- an amount of carryover particles 153 within the cross section A.

By using this information, one may then control a temperature of the black liquor in order to affect a size of the droplets 152, and in this way affect carryover.

For example, if carryover particles 153 are detected, or an increase in their amount is detected, a temperature of the black liquor can be decreased by using the the temperature controller 146. As another example, if a decrement in the amount of carryover particles 153 is detected, a temperature of the black liquor can be increased by using the the temperature controller 146.

Therefore, an embodiment of a method for controlling carryover in a chemical recovery boiler 100 comprises measuring information indicative of a spatial temperature distribution on the cross section A of the furnace 105, wherein the cross section A is above the injection gun 148 and below the first superheater 212. The embodiment comprises determining primary information I1 indicative of carryover. The primary information I1 is indicative of at least one of presence of carryover particles 153, change of an amount of carryover particles 153, and an amount of carryover particles 153 on the cross section A. The primary information I1 is determined using the information indicative of the spatial temperature distribution on the cross section A of the furnace. The embodiment further comprises controlling a temperature of the black liquor that is fed to the furnace using the primary information indicative of carryover.

The determination of the information related to carryover can be automated. Therefore, a chemical recovery boiler 100 comprises a processor CPU1 configured to determine primary information I1 indicative of carryover using the values indicative of the spatial temperature distribution on the cross section A of the furnace 105. For the purpose, the processor CPU1 uses the values received from the thermometer 310. In an embodiment, the processor CPU1 is configured to determine primary information I1 indicative of at least one of presence of carryover particles 153, change of an amount of carryover particles 153, and an amount of carryover particles 153 using the values indicative of the spatial temperature distribution on the cross section A of the furnace 105.

Referring to FIG. 1, the primary information I1 may be provided. The primary information I1 may be provided to an operator, who may control the process as needed. Thus, in an embodiment, the processor CPU1 is configured to provide the primary information I1. In the alternative or in addition, the processor CPU1 may be configured to generate a signal S using the primary information I1 and provide the signal S. The signal S may be provided e.g. to an operator. The signal S may comprise e.g. instructions for the operator.

Referring to FIG. 2, the primary information I1 may be used to automatically control the process, in particular the temperature of the black liquor. In this way, in an embodiment, the processor CPU1 is configured to control the temperature controller 146. The processor CPU1 may e.g. comprise multiple electronic components, such as microcontrollers, and the primary information I1 may be sent from one microcontroller to another microcontroller. Even if not shown in FIG. 2, the primary information I1 and/or the signal S may be provided even if the temperature controller 146 is controlled by the processor CPU1.

As the thermometer 310, in principle any known thermometer or a combination of any known thermometers is usable. Examples include:

- an acoustic pyrometer with at least two sound sources 312 and multiple sound detectors 314,
- temperature sensors arranged within the furnace 105,
- a light source and a light detector, and
- an optical pyrometer.

Thus, in an embodiment of the method, the information indicative of the spatial temperature distribution on the cross section of the furnace is measured by using at least one of the following: acoustic pyrometry, temperature sensors arranged within the furnace, spectroscopy, and optical pyrometry.

It has been found that acoustic pyrometry is a reliable method for determining the temperature profile in the harsh environment within the furnace. In acoustic pyrometry, a sound source 312 generates an acoustic signal, and a sound detector 314 or multiple sound detectors 314 detect(s) a time of flight of the signal between the source 312 and the detector 314. The time of flight is related to a temperature in between the source and the detector, as gases expand thermally, and the density of the gas affects the velocity of sound.

Figure 3:
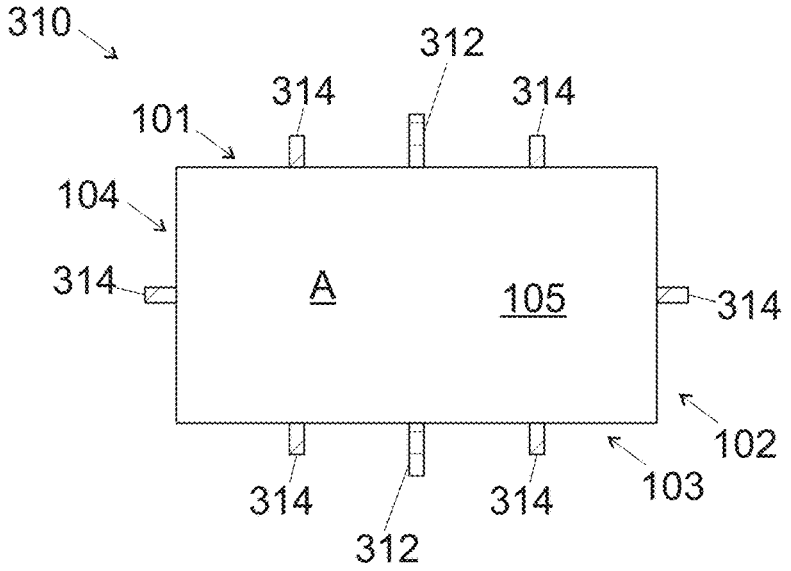
FIG. 3 is a top view of a cross section of a furnace of the chemical recovery boiler.

Referring to FIG. 3, a preferable embodiment of the thermometer 310 is based on acoustic pyrometry, and comprises at least two sound sources 312 and multiple sound detectors 314. Correspondingly, in an embodiment of the method, the information indicative of the spatial temperature distribution on the cross section of the furnace is measured by using acoustic pyrometry.

Referring to FIG. 3, in an embodiment, the chemical recovery boiler 100 comprises a first wall 101, a second wall 102 perpendicular to the first wall 101, a third wall 103 opposite to the first wall 101, and a fourth wall 104 opposite to the second wall 102, wherein the walls (101, 102, 103, 104) limit the furnace 105. When the thermometer 310 comprises at least two sound sources 312, one of them is arranged on the first wall 101 and another is arranged on another wall (102, 103, 104), preferably on the opposite wall, i.e. the third wall 103. The sound sources 312 are arranged at a vertical level or vertical levels that is/are above the injection gun(s) 148 and below the first superheater 212. In particular, when the cross section A is not horizontal, the sound sources 312 and detectors 314 need not be on the same vertical level.

Preferably, a sound detector 314 is arranged on each one of the walls 101, 102, 103, 104. The sound detectors 314 are arranged at a vertical level or vertical levels that is/are above the injection gun(s) 148 and below the first superheater 212.

Figure 4A:
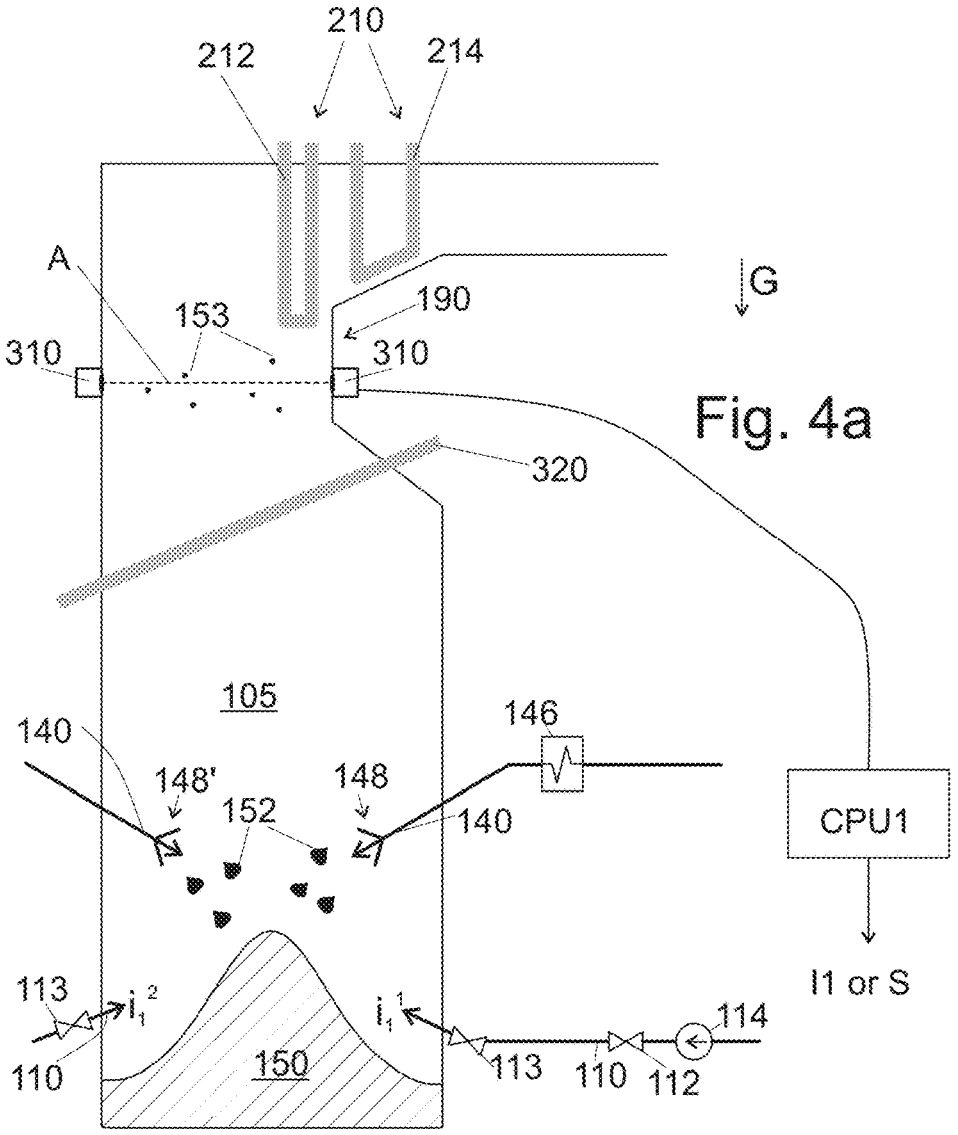
FIG. 4*a* is a principal side view of an embodiment of a chemical recovery boiler having a screen.
Figure 4B:
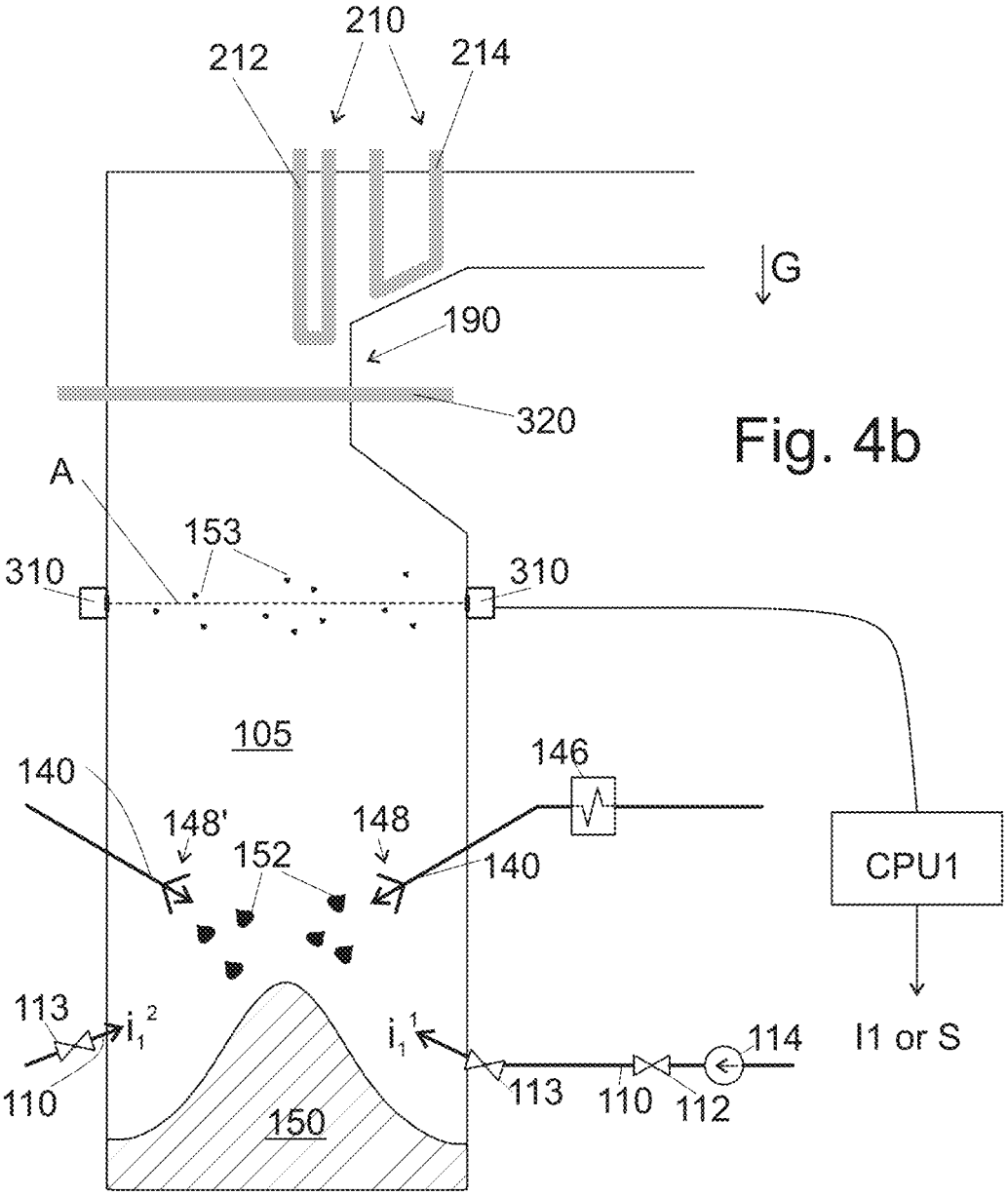
FIG. 4*b* is a principal side view of an embodiment of a chemical recovery boiler having a screen.

Referring to FIG. 4*a*, the thermometer 310 may be arranged at the same vertical level as the nose 190. Referring to FIG. 4*b*, the thermometer 310 may be arranged below the nose 190. The thermometer 310 may be arranged above the nose 190 (not shown).

Referring to FIGS. 4*a* and 4*b*, the chemical recovery boiler 100 may comprise a screen 320. The screen 320 comprises heat transfer pipes, and may act e.g. as a superheater, a reheater, an economizer, or a boiling pipe (e.g. riser or downcomer). Typically, at least a part of the screen 320 is arranged at a vertical level of the bullnose 190. If a screen 320 is used, it also protects the superheaters 210. For example, in the embodiment of FIG. 4*a* only a part of the screen 320 is arranged at a vertical level of the bullnose 190. For example, in the embodiment of FIG. 4*b*, the screen 320 is arranged at a vertical level of the bullnose 190.

When the chemical recovery boiler 100 comprises the screen 320, the thermometer 310 may be configured to measure values indicative of a spatial temperature distribution on a cross section A of the furnace 105 that is above a part of the screen 320 and below the first superheater 212, as indicated in FIG. 4*a*. Alternatively or in addition, when the chemical recovery boiler 100 comprises the screen 320, the thermometer 310 may be configured to measure values indicative of a spatial temperature distribution on a cross section A of the furnace 105 that is below a part of the screen 320 and above the injection gun(s) 148, as indicated in FIG. 4*b*. It is noted, the flue gases typically are so hot at the level of the screen, that the fly as of the flue gas is in molten form. Thus, typically, the fly as does not clog the screen, whereby the cross section A can be located above the screen 320, even if the screen may serve as a superheater. However, in case of very high carryover, the carryover itself may affect corrosion of the screen. Thus, in some cases it is beneficial that the cross section A is located blow the screen 320.

FIGS. 5*a* to 5*d* show examples of temperature profiles measured on the cross section A. Some of the temperatures are indicated by T1, T2, T3, T4, and T5, wherein T5>T4>T3>T2>T1. A magnitude of the temperature can be described by a statistical measure Tmag indicative of a magnitude of the temperature of the spatial temperature distribution. Examples of such measure are an average Tave, a percentile value, such as the 50% percentile value (i.e. median), a maximum Tmax or a minimum. A variation of the temperature can be described by a statistical measure Tvar indicative of a variation of the temperature of the spatial temperature distribution. Example of such measure include a difference Tmax−Tave between the maximum Tmax and the average Tave, a standard deviation σ, a variance $\sigma^2$, and a range (i.e. difference between a maximum and a minimum).

Figure 5A:
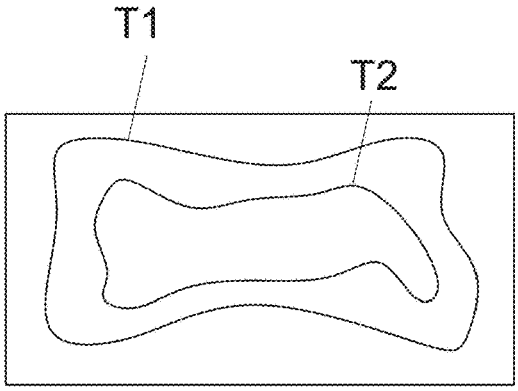
FIG. 5*a* shows a spatial temperature on a cross section of the furnace of the chemical recovery boiler under normal operating conditions.

FIG. 5*a* is an example of a temperature profile indicative of normal operation. As indicated above, the magnitude of the temperature can be described by a statistical measure Tmag indicative of a magnitude of the temperature of the spatial temperature distribution, such as the average Tave. In addition or alternatively to the magnitude, a variation of the temperature can be described by a statistical measure Tvar indicative of a variation of the temperature of the spatial temperature distribution, such as a difference Tmax−Tave between the maximum Tmax and the average Tave.

When the chemical recovery boiler 100 operates as designed, the statistical measure Tmag indicative of a magnitude of the temperature is within certain limits and the temperature distribution is substantially uniform, i.e. the statistical measure Tvar indicative of a variation of the temperature is low. More specifically, normally, the statistical measure Tvar indicative of a variation of the temperature is less than a first threshold TI1, and the statistical measure Tmag indicative of a magnitude of the temperature is less than a second threshold TI2, as indicated in FIG. 5*a*. In somewhat more general terms, when the chemical recovery boiler 100 operates as designed, a statistical measure (such as Tvar or Tmag) remains below a threshold (such as the first threshold or the second threshold) and/or above a threshold (such as a third threshold, as discussed below).

Figure 5B:
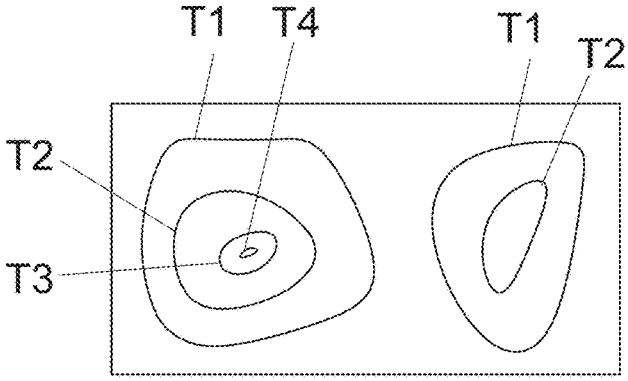
FIG. 5*b* shows a spatial temperature on a cross section of the furnace of the chemical recovery boiler, when the combustion is uneven, i.e. non-symmetric.

FIG. 5*b* is an example of temperature profile indicative of carryover. The variation of temperature is too large, whereby the statistical measure indicative of the variation, Tvar (e.g. Tmax−Tave), exceeds the first threshold TI1. This may happen e.g. if the feed of black liquor is uneven. Other possibilities include uneven air feed. However, the statistical measure indicative of magnitude, Tmag (e.g. Tave), may be within the limits of normal operation. To correct the situation, feed of black liquor and/or air can be controlled locally, i.e. at a certain location independent of the feed at another location. The local control may be performed automatically, i.e. by the processor CPU1, or by an operator, e.g. as a response to a signal S or the primary information I1 supplied by the control unit CPU1.

Figure 5C:
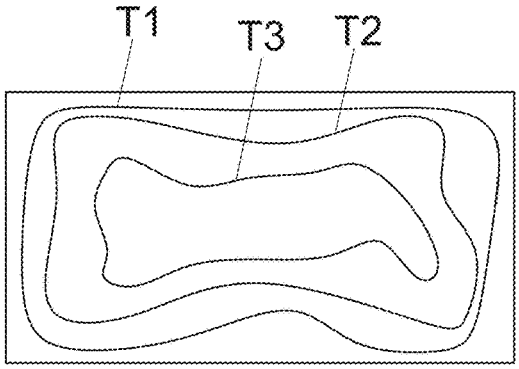
FIG. 5*c* shows a spatial temperature on a cross section of the furnace of the chemical recovery boiler, when an average temperature exceeds a limit.

FIG. 5*c* is an example of temperature profile indicative of carryover. The variation of temperature is within an acceptable level, whereby Tvar does not exceed the first threshold TI1. However, the magnitude Tmag exceeds the second threshold TI2. The magnitude Tmag (e.g. the average temperature Tave) may exceed the second threshold e.g. because the carryover particles burn at the level of the cross section A, thereby increasing the temperature. To correct the situation, feed of black liquor and/or air can be controlled, but need not be controlled locally. E.g. a temperature of the black liquor may be decreased in order to increase the size of the droplets 152, thereby reducing the number of carryover particles 153.

Figure 5D:
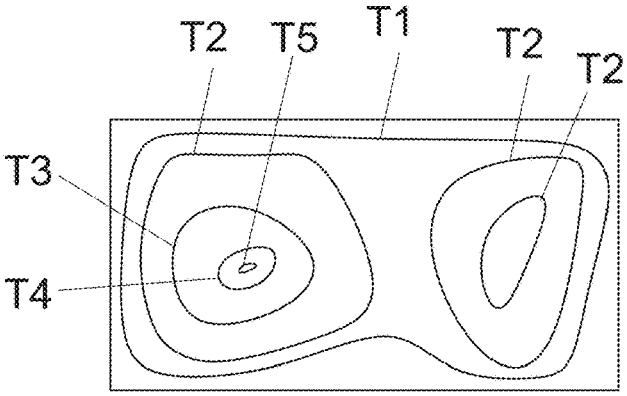
FIG. 5*d* shows a spatial temperature on a cross section of the furnace of the chemical recovery boiler, when the combustion is uneven, i.e. non-symmetric, and when an average temperature exceeds a limit.

FIG. 5*d* is an example of temperature profile indicative of carryover. Therein both the thresholds TI1 and TI2 are exceeded.

Referring in particular to FIGS. 5*b* and 5*d*, an embodiment of the method comprises determining the spatial temperature distribution on the cross section A of the furnace 105 using the information indicative of the spatial temperature distribution on the cross section of the furnace; determining a statistical measure Tvar indicative of a variation of the temperature of the spatial temperature distribution; and determining that the statistical measure Tvar indicative of the variation of the temperature exceeds a first threshold TI1. In this way the primary information I1 indicative of carryover is determined using the information indicative of the spatial temperature distribution on a cross section of the furnace. The primary information I1 is indicative of at least one of presence of carryover particles 153, change of an amount of carryover particles 153, and an amount of carryover particles 153.

An embodiment comprises determining an average temperature Tave from the spatial temperature distribution; determining a maximum temperature Tmax from the spatial temperature distribution; and calculating the statistical measure Tvar indicative of the variation of the temperature of the spatial temperature distribution as a difference Tmax−Tave between the maximum temperature Tmax and the average temperature Tave.

Typically, since the first threshold is exceeded, as a response, the method comprises in this case decreasing the temperature of the black liquor that is fed to the furnace. However, there may be other reasons, why the temperature of the black liquor that is fed to the furnace could be increased, e.g. if a temperature of char bed is simultaneously decreasing. In this case, air feed to the boiler 100 could be controlled.

Referring in particular to FIGS. 5*c* and 5*d*, an embodiment of the method comprises determining the spatial temperature distribution on the cross section A of the furnace 105 using the information indicative of the spatial temperature distribution on the cross section of the furnace; determining a statistical measure Tmag indicative of a magnitude of the temperature of the spatial temperature distribution; and determining that the statistical measure Tmag indicative of the magnitude of the temperature exceeds a second threshold T12. Thus, the embodiment comprises determining the primary information I1 indicative of carryover by using the information indicative of the spatial temperature distribution on the cross section A of the furnace 105. The primary information I1 is indicative of at least one of presence of carryover particles 153, change of an amount of carryover particles 153, and an amount of carryover particles 153. Since a high temperature may be an indication of carryover, the embodiment may comprise decreasing the temperature of the black liquor that is fed to the furnace 105. Furthermore, it is possible to affect carryover by the distribution of combustion air. For example, in some cases, the amount of combustion air that is fed below the injection gun(s) 148 may be decreased in order to reduce carryover.

It is also possible to determine that the statistical measure Tmag indicative of the magnitude of the temperature goes below a third threshold T13, and as a response thereto, increase the temperature of the black liquor that is fed to the furnace 105. A too low a temperature may be indicative of low reduction within the furnace, and as a corrective measure, the size of the droplets 152 may be decreased, even if this increases the risk of carryover.

An embodiment comprises determining an average temperature Tave from the spatial temperature distribution and using the average temperature as the statistical measure Tmag indicative of the magnitude of the temperature of the spatial temperature distribution.

In practice, a reference temperature Tref may be determined in such a manner, that in normal operation, the magnitude Tmag of the temperature should be substantially equal to the reference temperature Tref. Thus, instead of comparing the magnitude Tmag with the second threshold TI2, the difference Tmag−Tref between the statistical measure Tmag indicative of the magnitude of the temperature of the spatial temperature distribution and the reference temperature Tref may be compared with a fourth threshold T14, and carryover can be determined to be present, when Tmag−Tref>T14. However, this is equivalent to the case wherein Tmag>T12, provided that TI4=T12+Tref. So this is only a question of setting a proper threshold.

Figure 6:
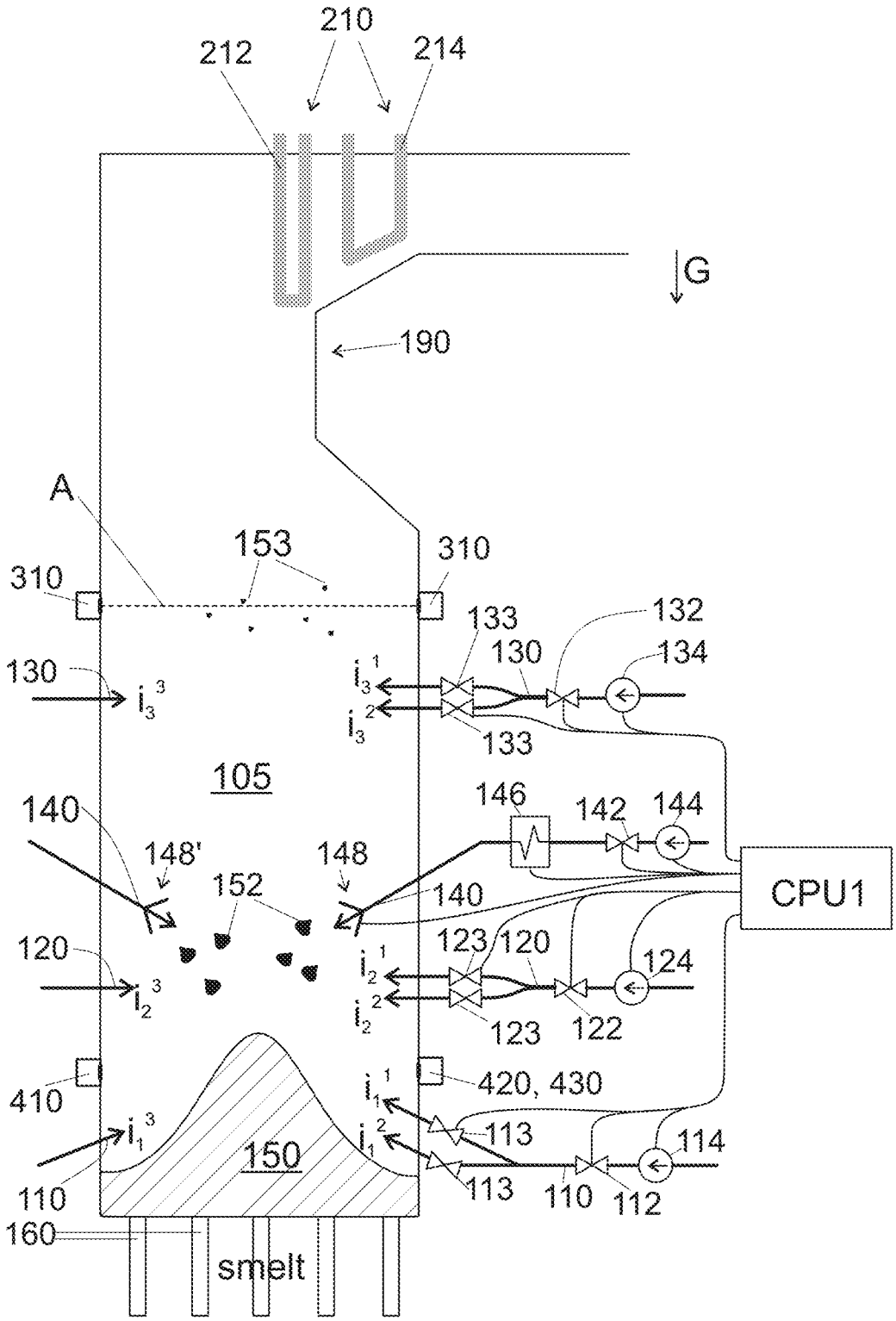
FIG. 6 is a principal side view of an embodiment of a chemical recovery boiler having multiple air inlets.

Concerning an uneven temperature distribution (see FIGS. 5*b* and 5*d*), in this case the carryover is preferably controlled locally in order to make the temperature distribution more even. The local control refers to control of combustion at one location independent of the combustion at another location, as detailed below. In the method, black liquor is fed through multiple injection guns 148 to the furnace 105. Moreover, combustion air is fed into the furnace through multiple inlets. Referring to FIG. 6, combustion air may be fed into the furnace 105 through a primary channel 110 for feeding primary combustion air and through a secondary channel 120 for feeding secondary combustion air. In addition, combustion air may be fed into the furnace 105 through an upper channel 130 for feeding upper combustion air. As indicated in FIG. 6, each one of the channels 110, 120, 130 may comprise multiple air inlets i. The embodiment comprises affecting combustion of the black liquor in such a way that a temperature variation of the spatial temperature distribution decreases. The difference Tmax−Tave is an example of a measure of the temperature variation of the spatial temperature distribution. The temperature variation may be affected by at least one of the following ways:

(a) by controlling an angle of an injection gun 148 (i.e. a first injection gun 148) independent of an angle of another injection gun 148' (i.e. a second injection gun 148'), (b) controlling a flow of the black liquor through an injection gun 148 (i.e. a first injection gun 148) independent of a flow of the black liquor through another injection gun 148' (i.e. a second injection gun 148'), and (c) controlling a flow of combustion air through an air inlet i (i.e. a first air inlet $i_n^{m)}$ independent of a flow of combustion air through another air inlet $i_x^y$ (i.e. a second air inlet $i_x^y$, wherein x≠n and/or y≠m).

Here the air inlets are commonly denoted by the reference i. Some of the air inlets are arranged at a vertical level n (e.g. first, wherein n=1; second, wherein n=2; and third, wherein n=3). The level is indicated by a subscript to the reference i. Thus, the air inlets i at the first level are denoted by the air inlets i at the second level are denoted by $i_2$; and the air inlets i at the third level are denoted by $i_3$. Moreover, as there typically are more than one air inlets i at each vertical level, a specific air inlet i as denoted by $i_n^m$, wherein n is the index of the vertical level, and m is a number for the air inlet at that vertical level (see FIG. 6). Both n and m are integers and at least one.

Regarding the option (a) the angle refers to the angle between the direction to which the injection gun 148 feed the black liquor and the downward vertical direction. This affects, on one hand carryover, and on the other hand the location, to which the droplets 152 are fed. The processor CPU1 may be configured to control the angle. This is indicated by the line from the processor CPU1 to the injection gun 148 in FIG. 6. In the alternative or in addition, an operator may control the angle. In such a case, the processor CPU1 may generate a signal S that comprises instructions to the operator.

Regarding the option (b) the flow of the black liquor through an injection gun 148 can be controlled e.g. by controlling a pump 144 configured to pump the black liquor and/or a valve 142 configured to limit the flow of black liquor. By using the valve 142 and/or the pump 144, a flow of black liquor through a certain injection gun 148 can be stopped, if needed. The pump 144 can be configured to control the pressure, by which the black liquor is fed through the injection gun 148. A set value for the pressure may be used to control the pump 144 and/or the valve 142 in such a way that a pressure of the black liquor in the injection gun 148 is controlled. In addition or alternatively, an orifice of the injection gun 148 can be controlled in a manner similar to the valve 142. By opening the orifice, more black liquor will be fed, and by closing, less. An orifice of an injection gun 148 can also be changed by an operator by applying a flow limiter to the injection gun 148. Such a limiter may be applied e.g. manually. The processor CPU1 may be configured to control at least one of the pump 144, the valve 142, and the orifice of the injection gun 148, as indicated by the lines from the processor CPU1 to these components in FIG. 6. In the alternative or in addition, an operator may control at least one of the pump 144, the valve 142, and the orifice of the injection gun 148. If needed, at least one of a pump 144, a valve 142, and an orifice of an injection gun 148' may be controlled such that the flow through that injection gun 148' is stopped. Correspondingly, black liquor would flow through another injection gun 148.

Regarding the option (c) the flow of the combustion air through an air inlet i can be controlled e.g. by controlling a fan (114, 124, 134) configured to feed combustion air and/or by controlling a valve (112, 113, 122, 123, 132, 133) configured to control the flow of combustion air. If nozzles are used to feed combustion air, the orifices of the nozzles can be controlled, if needed. In FIG. 6, the fan 114 is for conveying air to the primary channel 110 for feeding primary combustion air; the fan 124 is for conveying air to the secondary channel 120 for feeding secondary combustion air; and the fan 134 is for conveying air to the upper channel 130 for feeding upper combustion air. In FIG. 6, the valve 112 is for controlling the flow of air within the primary channel 110, i.e. the air flow to a first vertical level (e.g. primary air). Thus, the valve 112 may be used to control the total air flow through the air inlets $i_1^m$. In FIG. 6, the valve 122 is for controlling the flow of air within the secondary channel 120, i.e. the air flow to a second vertical level (e.g. secondary air). Thus, the valve 122 may be used to control the total air flow through the air inlets $i_2^m$. In FIG. 6, the valve 132 is for controlling the flow of air within the upper channel 130, i.e. the air flow to a third vertical level (e.g. tertiary air). Thus, the valve 132 may be used to control the total air flow through the air inlets $i_3^m$.

In FIG. 6, the valves 113 are for controlling the air flow through the different air inlets $i_1^m$ of the first vertical level. In FIG. 6, the valves 123 are for controlling the air flow through the different air inlets $i_2^m$ of the second vertical level. In FIG. 6, the valves 133 are for controlling the air flow through the different air inlets $i_3^m$ of the third vertical level. In this way, each one of the valves 112, 122, 132 can be used to control the total amount of combustion air to one of the vertical levels, as indicated above. Moreover, the valves 113 can be used to control the air distribution within the first vertical level, the valves 123 can be used to control the air distribution within the second vertical level, and the valves 133 can be used to control the air distribution within the third vertical level. Typically, baffles may serve as the valves 113, 123, 133 responsible for air distribution within a certain vertical level. The processor CPU1 may be configured to control at least one of the pumps 114, 124, 134 and/or at least one of the valves 112, 113, 122, 123, 132, 133 as indicated by the lines from the processor CPU1 to these components in FIG. 6. In the alternative or in addition, an operator may control least one of the pumps 114, 124, 134 and/or at least one of the valves 112, 113, 122, 123, 132, 133.

Regarding all the options a to c, it is noted that controlling is made independently, at least, when the statistical measure indicative of the variance exceeds the first threshold, as discussed above. Thus, the angle, the flow of black liquor, or the flow of combustion air is controlled at a first location in a different manner than at a second location. Moreover, the control is made such that a variation of the spatial temperature distribution decreases.

Regarding all the options a to c, it is noted that typically, the temperature of the black liquor need not be controlled locally. Thus, typically it suffices that the system comprises only one the temperature controller 146 that is configured to control the temperature of the black liquor. In an embodiment, the system comprises a temperature controller 146, such a heater, that is configured to control the temperature of the black liquor that it fed through at least two injection guns into the furnace 150. In an embodiment, the system comprises only one temperature controller 146, such a heater, that is configured to control the temperature of the black liquor that it fed through injection guns into the furnace 150. The black liquor may then be fed through all the injection guns that are in use. As indicated within this description, not all injection guns need to be used 148, i.e. the flow through some of them may be stopped.

Concerning a too high temperature (see FIGS. 5*c* and 5*d*), in this case the carryover is preferably controlled in order to decrease the temperature. However, the control needs not be local. The temperature may be affected by at least one of the following ways:

by controlling an angle of the injection gun, by controlling a flow of the black liquor through the injection gun, and by controlling a flow of combustion air into the furnace.

However, in this case, i.e. at least when the statistical measure indicative of the magnitude exceeds the second threshold, as discussed above, it suffices that the temperature is affected by at least one of the following ways:

by controlling a temperature of the black liquor, and by controlling a total flow of the combustion air to the vertical levels.

Regarding the last option, in other words, it may be sufficient to control at least one of the valves 112, 122, 123 configured to control the total amount of combustion air to one of the vertical levels. However, the valves 113, 123, 133 responsible for air distribution within a certain vertical level, may not need to be controlled.

What has been said about controlling the angle, a flow of black liquor, and a flow of combustion air applies also in this case. However, the angle and/or flow may be controlled at each location in a similar manner, i.e. dependent on each other. The processor CPU1 can be configured to control the components discussed above in the context of FIGS. 5*b*, 5*d*, and 6 in the manner described above in the context of FIGS. 5*c* and 5*d*. The processor CPU1 can be configured to form a signal S comprising instructions for the operator.

As indicated above, carryover can be detected by measuring a temperature distribution of the cross section A (or at least information related thereto). Oftentimes such measurements indicate that carryover is present, whereby an appropriate correction would be e.g. to increase droplet size e.g. by reducing the temperature of the black liquor.

However, in order to have good reduction efficiency, the droplet size must not be too high. Therefore, preferably the method comprises also increasing the temperature of the black liquor that is fed through the injection gun(s) 148. As a result, the size of the droplets 152 decreases, and a risk for carryover increases. As a simple procedure, the temperature of the black liquor fed through the injection gun(s) 148 can be increased from time to time, and if carryover is observed as detailed above, the temperature of the black liquor fed through the injection gun(s) 148 can be decreased as a corrective measure. As an alternative and as indicated above, an indication of low reduction may be the low temperature of the flue gases as measured by the thermometer 310.

However, preferably a proper reduction efficiency is determined by analyzing the char bed 150. At least one of a height of the char bed 150, a shape of the char bed 150, and a temperature of the char bed 150 can be measured for the purpose. A too high a char bed 150 and/or an increasing height thereof typically indicates that the droplets 152 are too large in view of good reduction efficiency. An improper shape may be an indication of an uneven (i.e. non-symmetric) combustion. In normal operation, the height and the shape of the char bed should remain stable. Thus, a correction may be applied when a change in at least one of the height and the shape is measured. As indicated above, increasing the size of the droplets 152 tends to increase the height of the char bed. Moreover, increasing a flow of black liquor tends to increase the height of the char bed. By applying such control locally, the shape and/or height can be locally affected.

In addition, the temperature of the char bed 150 should be in a designed range to ensure good reduction efficiency. Typically, a high temperature of the char bed 150 indicates high reduction efficiency. Typically, reduction starts at about 800° C., whereby a temperature of the char bed 150 is at least 800° C., preferably in the range of from 850° C. to 1100° C. A higher temperature may be problematic in view the material's thermal resistance. For example, a too hot char bed 150 may induce high thermal stress to the structures and/or the material may not be designed to withstand such high temperatures.

Figure 7:
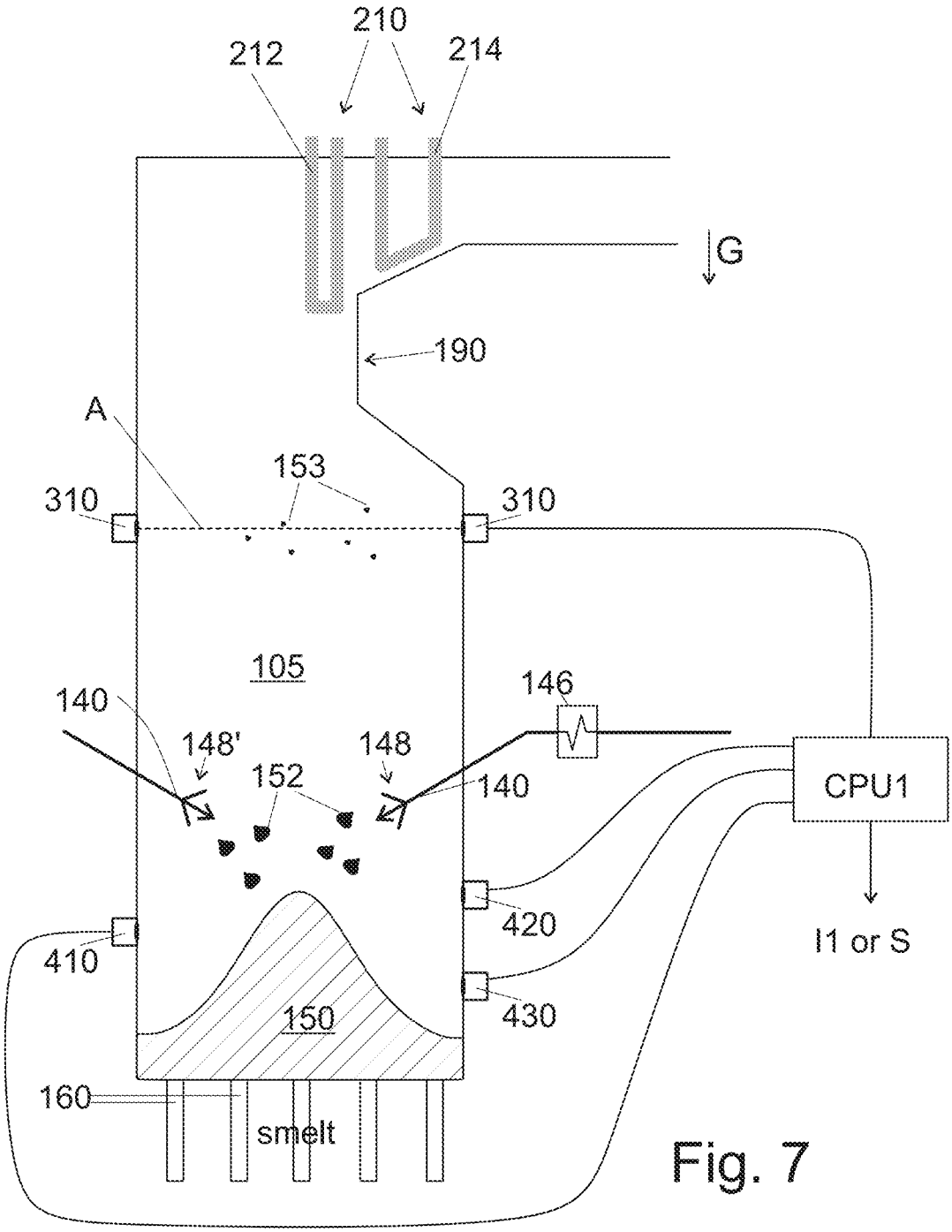
FIG. 7 is a principal side view of an embodiment of a chemical recovery boiler having a secondary thermometer, a height meter, and a shape meter, each one configured to measure the respective quantity from the char bed of the chemical recovery boiler.

For these reasons, and with reference to FIG. 7, in an embodiment, the chemical recovery boiler 100 comprises a second thermometer 410. The second thermometer 410 is configured to measure a temperature of the char bed 150, which has been formed in the furnace 105. In addition, the second thermometer 410 is configured to provide a measured temperature of the char bed 150. When the char bed 150 forms, at least a part of the char bed 150 is arranged at a lower vertical level than the injection gun(s) 148. In addition or alternatively, in an embodiment, the chemical recovery boiler 100 comprises a height meter 420. In addition or alternatively, in an embodiment, the chemical recovery boiler 100 comprises a shape meter 430. The height meter 420 is configured to measure a height of the char bed 150. The shape meter 430 is configured to measure a shape of the char bed 150. Even if FIG. 7 shows each one of the second thermometer 410, the height meter 420, and the shape meter 430, the chemical recover boiler 100 needs not comprise both, but it (100) may comprise one of them (410, 420, or 430) or two of them [(410 and 420), (410 and 430), or (420, and 430)], or all of them. As indicated in FIG. 1, the chemical recover boiler 100 needs not comprise any one of them (410, 420, 430). Preferably, the chemical recovery boiler 100 comprises the second thermometer 410 configured to measure a temperature of the char bed 150.

Referring to the determination of the temperature of the char bed 150, an embodiment of the method comprises determining a temperature of the char bed 150, and determining primary information indicative of reduction efficiency of the chemical recovery boiler by comparing the temperature of the char bed 150 to a reference value. As indicated above, this can also be used to control carryover and/or reduction efficiency, e.g. by controlling a size of the droplets 152 by means described earlier. Therefore, the embodiment comprises controlling the temperature of the black liquor that is fed to the furnace 105 using the primary information indicative of reduction efficiency of the chemical recovery boiler. The aforementioned reference value may be e.g. a constant reference value, whereby an absolute value of a difference between the measured temperature and the reference value should be small. The aforementioned reference value may be e.g. a previously measured temperature of the char bed, whereby an absolute value of a difference between the measured temperature and the reference value would indicate a rate of change of the temperature of the char bed.

As for determining primary information indicative of reduction efficiency of the chemical recovery boiler 100, it is noted that the temperature of the char bed 150 as such may serve as the information indicative of the reduction efficiency.

It may happen that decreasing the carryover has resulted in too low a temperature of the char bed 150 and/or too rapid a temperature decrease. In response, the size of the droplets may be decreased. Thus, an embodiment comprises determining that the temperature of the char bed goes below a reference value, and as a consequence of such determination, increasing the temperature of the black liquor that is fed to the furnace 105.

In addition to controlling the temperature of the black liquor, the reduction efficiency can be controlled by controlling the same process parameters that can be used to control the carryover, as detailed above. Therefore, an embodiment comprises controlling, by using the primary information indicative of reduction efficiency of the chemical recovery boiler 100, at least one of the following: an angle of the injection gun 148, a flow of the black liquor through the injection gun 148, and a flow of combustion air into the furnace 105. What has been said about different ways of controlling the angle, the flow of black liquor, and the flow of combustion air above applies also when at least one of these quantities is controlled by using the primary information indicative of reduction efficiency of the chemical recovery boiler 100.

Such controlling may be done by an operator of the chemical recovery boiler 100. In the alternative or in addition, the control may be automated. Correspondingly, the processor CPU1 may be configured to control the process. Therefore, in an embodiment of the chemical recovery boiler 100 the processor CPU1 is configured to determine primary information indicative of reduction efficiency of the chemical recovery boiler 100 by using information obtainable from the second thermometer 410. Moreover, in an embodiment, the processor CPU1 is configured to perform at least one of the following:

- control the temperature controller 146 using the primary information indicative of reduction efficiency of the chemical recovery boiler,
- provide the primary information indicative of reduction efficiency of the chemical recovery boiler, and/or
- generate a signal using the primary information indicative of reduction efficiency of the chemical recovery boiler and provide the signal.

However, when the temperature of the char bed 150 suffices as the primary information indicative of reduction efficiency of the chemical recovery boiler 100, the processor CPU1 may be configured to [A] control the temperature controller 146 using the measured temperature of the char bed 150, [B] provide the measured temperature of the char bed 150, and/or [C] generate a signal using the measured temperature of the char bed 150.

The temperature of the char bed 150 may be determined e.g. by optical pyrometry. A camera may be used as the pyrometer that determines the temperature of the char bed 150, i.e. as the second thermometer 410.

Instead of using the temperature of the chard bed 150 as discussed above it is naturally possible to use any information indicative of the temperature of the char bed 150 in a similar manner. Correspondingly, instead of measuring the temperature of the chard bed 150 as discussed above it is naturally possible to measure any information indicative of the temperature of the char bed 150.

Referring to the determination of the height and/or shape of the char bed 150, an embodiment of the method comprises determining a height and/or a shape of the char bed 150. The height and the shape (both in combination and in isolation) of the char bed 150 are related, on one hand, to carryover. For example a too rapid decrease in the height typically is an indication of carryover or too much carryover. A non-symmetric shape is evidence of non-symmetric combustion and therefore typically also carryover. On the other hand, height and/or shape of the char bed 150 is related to the reduction, since carryover and reduction are interrelated phenomena. For example a too rapid increase in the height typically is an indication of poor reduction efficiency. Therefore, from the height of the char bed 150, from the shape of the char bed 150, or from both the height and the shape of the char bed one can determine

- secondary information indicative of carryover (e.g. indicative of at least one of presence of carryover particles, change of an amount of carryover particles, and an amount of carryover particles; e.g. by comparing the height of the char bed to a reference height or by comparing the shape of the char bed to a reference shape) and/or
- secondary information indicative of reduction of the chemical recovery boiler.

However, neither one of these pieces of information need to be determined, since the height and/or shape of the char bed 150 as such can be used to control the chemical recovery boiler.

The corresponding embodiment of the method comprises controlling at least the temperature of the black liquor that is fed to the furnace using the height and/or shape of the char bed 150. In this way, in an embodiment, both the information indicative of a spatial temperature distribution on a cross section A of the furnace 105 and the height and/or shape of the char bed 150 are used for controlling at least the temperature of the black liquor that is fed to the furnace 105.

In this case carryover can be controlled as indicated above. Therefore, an embodiment comprises controlling, by using the height and/or shape of the char bed 150, at least one of the following: an angle of the injection gun 148, a flow of the black liquor through the injection gun 148, and a flow of combustion air into the furnace 105. What has been said about different ways of controlling the angle, the flow of black liquor, and the flow of combustion air above applies also when at least one of these quantities is controlled by using the primary information indicative of reduction efficiency of the chemical recovery boiler 100.

The control may be automated or it may be done by an operator. For these reasons, in an embodiment, the processor CPU1 is configured to [A] control the temperature controller 146 using the height and/or shape of a char bed 150, [B] provide the height and/or shape of a char bed 150, and/or [C] generate a signal using the height and/or shape of a char bed 150.

In case intermediate information is used, the processor is configured to determine secondary information indicative of carryover by using information obtainable from the height meter 420 and/or the shape meter 430. Moreover, in that case, the processor is configured to [A] control the temperature controller 146 using the secondary information, [B] provide the secondary information, and/or [C] generate a signal using the secondary information and provide the signal.

A camera may be used as the height meter 420. A camera may be used as the shape meter 430. The same camera may be used as a combined height and shape meter. Moreover, a camera may serve as the second thermometer 410. Thus, a single camera may serve as the second thermometer 410 and [i] the height meter 420, [ii] the shape meter 430, or [iii] the height meter 420 and the shape meter 430. However, preferably, the chemical recovery boiler 100, comprises at least two cameras, that are, in combination, configured to measure a temperature of the char bed 150 and at least one of the height and the shape of the char bed. More preferably, the chemical recovery boiler 100, comprises at least three cameras, that are, in combination, configured to measure a temperature of the char bed 150 and at least one of the height and the shape of the char bed. By using at least two cameras, the height and/or shape or the char bed can be measured from a large area of the furnace of chemical recovery boiler. Moreover, by using at least three cameras, three-dimensional information on the height and/or shape or the char bed can be measured, whereby a volume of the char bed can be determined even more accurately.

Instead of using the height and/or shape of the chard bed 150 as discussed above it is naturally possible to use any information indicative of the height and/or shape of the char bed 150 in a similar manner. Correspondingly, instead of measuring the height and/or shape of the chard bed 150 as discussed above it is naturally possible to measure any information indicative of the height and/or shape of the char bed 150.

The invention claimed is:

1. A method for controlling carryover in a chemical recovery boiler, the method comprising the steps of:

feeding black or brown liquor to a furnace of the chemical recovery boiler through an injection gun to burn the black or brown liquor, wherein the chemical recovery boiler comprises a bullnose, which narrows the furnace, and a first superheater, of which at least a part is arranged at a higher vertical level than the bullnose, measuring information indicative of a spatial temperature distribution on a cross section of the furnace, wherein the cross section is above the injection gun and below the first superheater, determining, by using the information indicative of the spatial temperature distribution on the cross section of the furnace, primary information that is indicative of at least one of: presence of carryover particles within the cross section of the furnace, an amount of the carryover particles within the cross section of the furnace, and a change of the amount of the carryover particles within the cross section of the furnace, and controlling a temperature of the black or brown liquor that is fed to the furnace using the primary information.

2. The method of claim 1, further comprising the steps of:

determining the spatial temperature distribution on the cross section of the furnace using the information indicative of the spatial temperature distribution on the cross section of the furnace, determining a statistical measure of the spatial temperature distribution, and determining that the statistical measure exceeds a threshold to determine the primary information.

3. The method of claim 1, further comprising the steps of:

determining the spatial temperature distribution on the cross section of the furnace using the information indicative of the spatial temperature distribution on the cross section of the furnace, determining a statistical measure indicative of a variation of the spatial temperature distribution, and determining that the statistical measure indicative of the variation exceeds a first threshold to determine the primary information.

4. The method of claim 3, wherein:

black or brown liquor is fed through multiple injection guns to the furnace, the method comprises:

feeding combustion air into the furnace through multiple air inlets; and affecting combustion of the black or brown liquor in such a way that a variation of the spatial temperature distribution decreases.

5. The method of claim 3, further comprising the steps of:

determining a statistical measure indicative of a magnitude of the spatial temperature distribution, and determining that the statistical measure indicative of the magnitude exceeds a second threshold to determining the primary information.

6. The method of claim 3, further comprising decreasing the temperature of the black or brown liquor that is fed to the furnace.

7. The method of claim 1, further comprising the steps of:

determining the spatial temperature distribution on the cross section of the furnace using the information indicative of the spatial temperature distribution on the cross section of the furnace, determining a statistical measure indicative of a magnitude of the spatial temperature distribution, and determining that the statistical measure indicative of the magnitude exceeds a threshold to determining the primary information.

8. The method of claim 7, further comprising decreasing the temperature of the black or brown liquor that is fed to the furnace.

9. The method of claim 1, wherein the information indicative of the spatial temperature distribution on the cross section of the furnace is measured by using at least one of the following: acoustic pyrometry, temperature sensors arranged within the furnace, spectroscopy, or optical pyrometrybly.

10. The method of claim 1, further comprising:

controlling, by using the primary information, a flow of combustion air into the furnace;

wherein the flow of combustion air into the furnace is controlled by controlling at least such a valve that is configured to control a total amount of combustion air to a vertical level of the chemical recovery boiler.

11. The method of claim 1, wherein:

a char bed is formed in the furnace such that at least a part of the char bed is arranged at a lower vertical level than the injection gun, and the method further comprises:

determining information indicative of a height and/or shape of the char bed, and controlling the temperature of the black or brown liquor that is fed to the furnace using the information indicative of height and/or shape of the char bed.

12. The method of claim 11, further comprising:

determining information indicative of a temperature of the char bed, and controlling the temperature of the black or brown liquor that is fed to the furnace using the information indicative of the temperature of the char bed.

13. The method of claim 1, wherein:

a char bed is formed in the furnace such that at least a part of the char bed is arranged at a lower vertical level than the injection gun, and the method further comprises:

determining information indicative of a temperature of the char bed, and controlling the temperature of the black or brown liquor that is fed to the furnace using the information indicative of the temperature of the char bed.

14. A chemical recovery boiler, comprising:

a furnace, a bullnose, which narrows the furnace, a first superheater, of which at least a part is arranged at a higher vertical level than the bullnose, an injection gun for feeding black or brown liquor into the furnace, a thermometer configured to measure values indicative of a spatial temperature distribution on a cross section of the furnace, wherein the cross section is above the injection gun and below the first superheater, a temperature controller configured to control a temperature of the black or brown liquor that is fed by the injection gun, and a processor configured to determine, using the values indicative of the spatial temperature distribution on the cross section of the furnace, primary information indicative of at least one of: presence of carryover particles within the cross section of the furnace, an amount of the carryover particles within the cross section of the furnace, and a change of the amount of the carryover particles within the cross section of the furnace.

15. The chemical recovery boiler of claim 14, wherein the processor is configured to at least one of:

control the temperature controller using the primary information, provide the primary information to an operator, or generate a signal using the primary information and provide the signal to an operator.

16. The chemical recovery boiler of claim 14, further comprising:

multiple injection guns for feeding black or brown liquor into the furnace, and multiple air inlets for feeding combustion air into the furnace, wherein the processor is further configured to at least one of:

control an angle of a first injection gun independent of an angle of a second injection gun, control a flow of the black or brown liquor through a first injection gun independent of a flow of the black or brown liquor through a second injection gun, or control a flow of combustion air through a first air inlet independent of a flow of combustion air through a second air inlet.

17. The chemical recovery boiler of claim 14, wherein the thermometer comprises at least one of the following:

an acoustic pyrometer having at least two sound sources and multiple sound detectors, temperature sensors arranged within the furnace, a light source and a light detector, or an optical pyrometer.

18. The chemical recovery boiler of claim 14, wherein the thermometer comprises an acoustic pyrometer having at least two sound sources and multiple sound detectors.

19. The chemical recovery boiler of claim 14, further comprising:

at least one of a height meter and a shape meter, such as a camera, configured to provide information indicative of a height and/or shape of a char bed formed in the furnace at such a level that at least a part of the char bed is arranged at a lower vertical level than the injection gun, wherein the processor is configured to receive information from at least one of the height meter and the shape meter.

20. The chemical recovery boiler of claim 19, wherein the at least one of a height meter and a shape meter is configured to provide information indicative of a temperature of a char bed formed in the furnace at such a level that at least a part of the char bed is arranged at a lower vertical level than the injection gun.

21. The chemical recovery boiler of claim 14, further comprising:

a second thermometer configured to provide information indicative of a temperature of a char bed formed in the furnace at such a level that at least a part of the char bed is arranged at a lower vertical level than the injection gun, wherein the processor is configured to receive information from the second thermometer.

* * * * *